US006273592B1

(12) United States Patent
Herst et al.

(10) Patent No.: US 6,273,592 B1
(45) Date of Patent: Aug. 14, 2001

(54) LUMINAIRE HAVING BAFFLES WITH OBSERVABLE VISUAL ACCENT

(75) Inventors: Douglas J. Herst, Ross; Peter Y. Y. Ngai, Alamo; Hue Ly, Richmond, all of CA (US)

(73) Assignee: NSI Enterprises, Inc., Atlanta, GA (US)

( * ) Notice: Subject to any disclaimer, the term of this patent is extended or adjusted under 35 U.S.C. 154(b) by 0 days.

(21) Appl. No.: 09/436,698

(22) Filed: Nov. 8, 1999

Related U.S. Application Data

(63) Continuation-in-part of application No. 09/075,504, filed on May 8, 1998, now abandoned.

(51) Int. Cl.[7] ..... F21V 7/00
(52) U.S. Cl. ..... 362/342; 362/297; 362/342
(58) Field of Search ..... 362/260, 290, 362/291, 292, 297, 325, 342, 346

(56) References Cited

U.S. PATENT DOCUMENTS 4,390,930 6/1983 Herst et al. .
5,662,403 * 9/1997 Akashi et al. ..... 362/32
6,056,416 5/2000 Ngai et al. .

OTHER PUBLICATIONS

Peerless product brochure, 6×3 Wall Wash, 1996.

* cited by examiner

*Primary Examiner*—Nimeshkumar D. Patel
*Assistant Examiner*—Todd R. Hopper
(74) *Attorney, Agent, or Firm*—Donald L. Beeson

(57) ABSTRACT

A luminaire 11 has baffle elements 31 in the down light opening of the luminaire's housing 15 for shielding the luminaire's light source 27 from direct view at normal viewing angles S. The bottom edges 51 of the baffle elements are provided with visual accent areas 55 which, at shielded viewing angles, exhibit relatively high observable brightness as compared to the relatively low observable brightness of the baffle elements' reflective surfaces 53. The visual accent area of the baffle elements is relatively small as compared to the baffles' reflective surfaces so as to produce a visual accent without visual discomfort associated with direct and reflected glare.

38 Claims, 7 Drawing Sheets

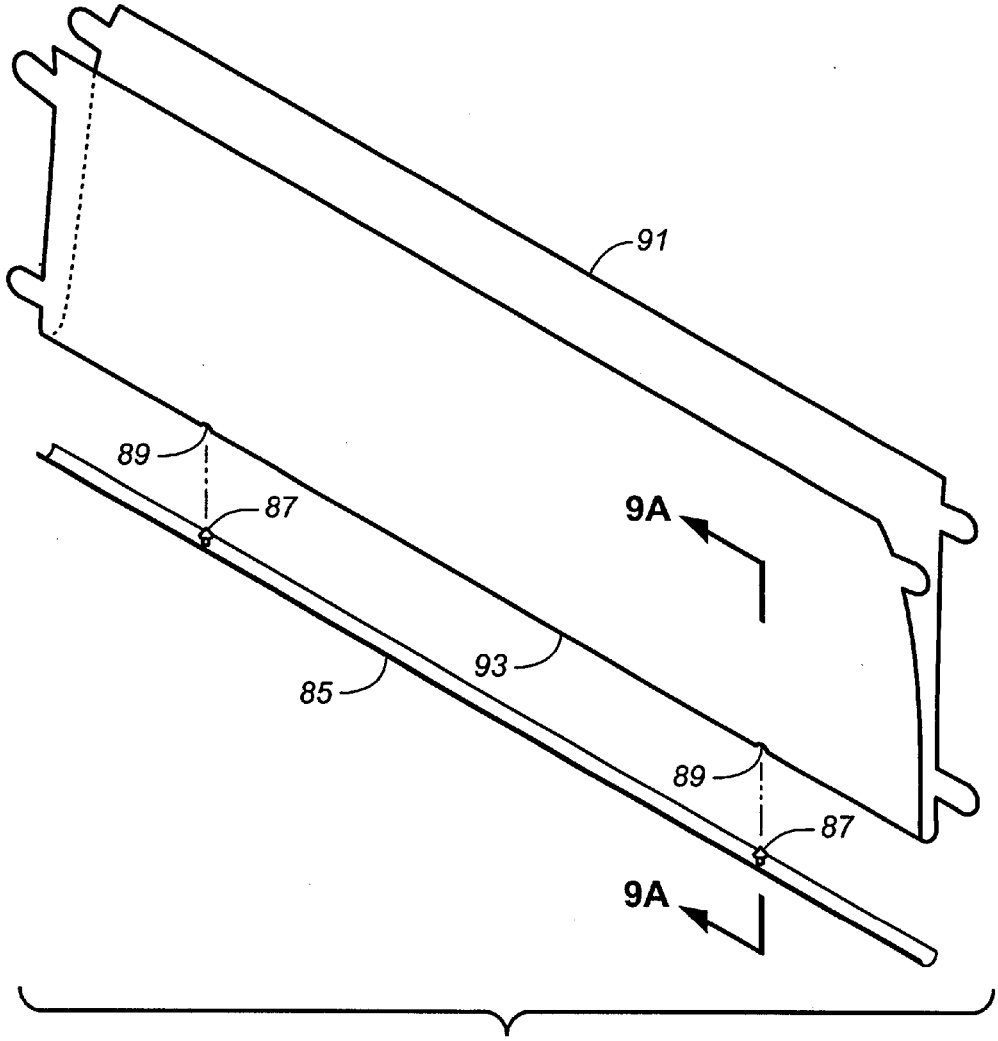
FIG._9
FIG._9A
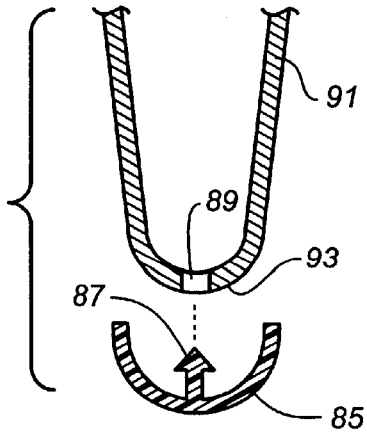
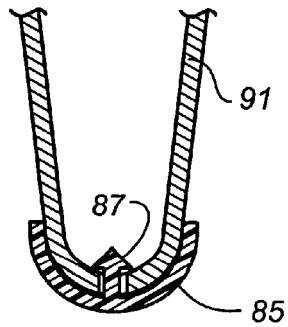
FIG._9B

LUMINAIRE HAVING BAFFLES WITH OBSERVABLE VISUAL ACCENT

CROSS-REFERENCE TO RELATED APPLICATIONS

This is a continuation in part of application Ser. No. 09/075,504, filed May 8, 1998, now abandoned.

BACKGROUND OF THE INVENTION

The present invention generally relates to luminaires, and more particularly to luminaires employing baffles or louvers in their down light openings to shield the luminaire's light source from direct view. The invention has particular application in connection with suspended linear fluorescent lighting having baffled down light openings, but can also be applied to other types of suspended or recessed lighting where baffles or louvers are used. As used herein, the terms "baffles" and "louvers" may be used interchangeably.

Luminaires are used for overhead lighting in a wide variety of commercial, institutional, and office environments. Such luminaires are usually characterized as direct luminaires, indirect luminaires or direct/indirect luminaires, depending on how the source light is delivered from the luminaire to the space below. In the case of a totally indirect luminaire, the luminaire's light source is hidden within the luminaire housing, and thus the surfaces of the lamps which act as the source of light are shielded from view. However, in the case of luminaires that produce direct lighting, the lamps of the luminaire are typically exposed through a down light opening in the bottom of the luminaire, which must be shielded to avoid visual discomfort associated with exposed lamp surfaces. One form of shielding is to use a plastic lens or diffuser plate which covers the down light opening. The difficulty with such shielding is that it traps heat and causes the luminaire to operate less efficiently. Also, the visible surfaces of the lens or diffuser plates are themselves relatively bright, thereby creating their own source of visual discomfort.

To overcome the problems associated with lenses and diffusers, lighting designers frequently specify direct (or direct-indirect) luminaires having open baffle structures which shield the luminaire lamps at angles where the introduction of glare is of greatest concern, yet which allow the lamps to burn at a cooler temperature and thus more efficiently. Conventional baffle structures usually include a series of parallel baffle elements or a grid pattern of baffles (usually referred to as a louver) arranged in the luminaire's down light opening to shield the lamps at normal viewing angles at any distant position around the luminaire. For efficiency, the baffle surfaces are typically reflectors and thus can themselves become a source of unwanted excessive brightness. To prevent this, so-called "parabolic" baffles are now most commonly used, instead of straight baffles. Parabolic baffles have curved specular reflective surfaces that control reflections in a manner that essentially eliminates any substantial surface brightness within shielded viewing angles. Importantly, by using parabolic baffles, a lighting designer can readily control brightness to meet limitations established by the ANSI RP-1 standards adopted in 1993 for direct lighting in the video display terminal (VDT) environments commonly found in present day offices. In such lighting environments, RP-1 compliant luminaires are critical to avoiding the undesirable effects of direct and reflected glare on the comfort of a worker who spends substantial time in front of a VDT screen.

However, the recognized advantages of parabolic baffles have given rise to what many consider to be a distinct drawback for luminaires which use such baffles: at normal viewing angles, and in particular angles controlled by the RP-1 standard, the baffled down light opening of the luminaire normally appears dark without any substantial clue as to the source of the down light. This can be a particular disadvantage in many lighting environments, such as open offices, where task-based recommended lighting levels are relatively low, down to about 30 footcandles. In such environments visual comfort and overall lighting quality actually suffer from the absence of visual clues as to the source of light, since in absence of such visual clues the illuminated space will often appear to be too dark and/or devoid of visual interest. In addition, the very presence of a dark void in the luminaire's down light opening resulting from a well-designed parabolic baffle structure is considered by many to be psychologically unpleasant, due to a lack of perceptible brightness.

The present invention overcomes the above-mentioned disadvantages of parabolic down light baffle structures while preserving the benefits of an open shielding structure, that is, the ability to gain efficiency while shielding the light source at desired viewing angles without introducing excessive brightness. The invention, which can be used in many different lighting environments in addition to the VDT environment, provides effective shielding while providing visual interest along with visual clues as to the location of the light source. The baffle structures of the invention will generally improve the quality of direct lighting received from shielded overhead lighting fixtures, and will eliminate the "dark hole" effect associated with parabolic baffles and louvers. The invention can also be used to introduce specific orientation and circulation information in any space whether architectural or in an outdoor setting.

SUMMARY OF THE INVENTION

Briefly, the present invention involves a luminaire comprised of a housing having a down light opening extending in a defined plane. At least one light baffle element is disposed in the down light opening to shield the light source within a range of shielded viewing angles below the plane of the down light opening. The baffle element has at least one, and typically two back-to-back observable surfaces which extend upward from a bottom edge of the baffle and which exhibit low brightness at at least some if not all shielded viewing angles so as to prevent the visual discomfort normally associated with excessively bright surfaces. In the preferred embodiment, the observable surfaces of the baffle element are specular or semi-specular reflective surfaces formed to direct reflected source light away from shielded viewing angles. However, it is understood that the invention will encompass other baffle designs, such as baffles having light absorptive surfaces, so long as the brightness of the observable surfaces of the baffles is suitably controlled.

In accordance with the invention, a small visual accent area is provided in proximity to and preferably on the light baffle element so that it is observable at some shielded viewing angles within the range of shielded viewing angles where the surface of the baffle exhibits low brightness. At these angles, the visual accent area exhibits relatively high brightness as compared to the relatively low brightness of the observable baffle surfaces. The resulting contrast in observable brightness on the baffle elements provides a visual clue as to the source of light and provides visual interest to the luminaire by supplying an observable accent within otherwise dark regions of the luminaire's baffle structure. Also, it introduces a desirable perception of brightness and a sense of comfortable lighting levels in an illuminated space that might otherwise appear too dark.

Typically, the down light opening of the luminaire will be shielded with a series of baffle elements, some or all of which will have a visual accent area to provide a series of visual accent areas observable within the shielded viewing zone. Preferably, the visual accent area of each light baffle element is provided at or proximate to the bottom edge of the light baffle element, and has a surface area that is very small relative to the overall surface area of the baffle's observable surface. More specifically, the accent area is suitably provided by a reflective stripe running along and over the bottom edge of the baffle elements. This stripe can be applied in the form of a reflective paint, a strip of reflective adhesive material, or other suitable means, and is applied so that it extends upward from the baffle's bottom edge onto its observable surfaces far enough to produce a suitable perception of brightness along the bottom of the baffles at shielded viewing angles, but not so far as to introduce excessive brightness.

In a further aspect of the invention, visual accents are applied to the bottom edges of the luminaire baffles by means of channel-shaped cover strips having high reflectance non-specular exterior surfaces. By using structural elements fitted over the baffles' bottom edges, accents having visually distracting irregularities and non-uniformities from baffle to baffle can be avoided. Also, accents can be replaced if their luminous surfaces become damaged or if accents of different colors are desired.

In yet another aspect of the invention, baffle elements of the luminaire are provided in the form of separate back-to-back baffle walls which converge to a narrow channel at the bottom edge of the baffle, and an elongated opaque or translucent accent bar sandwiched between the baffle walls at the bottom edge thereof. The lower edge of the accent bar projects from the bottom edge of the baffle walls so as to be observable within shielded viewing angles. The accent bar, which is suitably fabricated of a white opal acrylic plastic material, provides an accent stripe of increased brightness along the bottom edge of the baffle and has an observable surface area that is controlled by the amount of projection below the bottom edge of the baffle walls. By providing an accent bar having suitable translucency, brightness along the bottom of the baffles can produced from light passing through the bar element as opposed to being produced by entirely reflected light. Again, with this embodiment an accent stripe can be produced along the bottom edge of the baffles without visually distracting irregularities.

The invention still further pertains to a method of providing visual interest to a luminaire having a light source, a down light opening below the light source, and baffle elements in the down light opening for shielding the light source at desired shielded viewing angles. The method involves providing a small visual accent area of relatively high brightness on the baffles which is observable at at least some shielded viewing angles and otherwise avoiding high brightness surfaces on the baffles at such viewing angles. The method also involves illuminating architectural and/or outdoor spaces with luminaires in accordance with the invention using visual accent areas in different colors at different locations to communicate orientation within and among spaces.

Therefore, it can be seen that a primary objective of the present invention is to provide a direct (or direct-indirect) luminaire having an open baffle structure with visual light clues in the baffled down light opening of the luminaire for locating the source of down light. It is another object of the invention to provide such a direct or direct-indirect luminaire with visual interest and accents in the region of the luminaire's baffled down light opening. It is a further object of the invention to provide such a luminaire with visual light clues for communicating orientation and circulation within and among different spaces. It is still another object of the invention to provide repeating accents which have no irregularites and which are uniform from accent area to accent area. Yet other objects of the invention will be apparent from the following specification and claims, as well as from the accompanying drawings.

DESCRIPTION OF THE DRAWINGS

FIG. 9 is a top perspective view of another embodiment of a channel-shaped cover strip removably securable to the bottom edge of the baffle element.

FIGS. 9A and 9B are enlarged fragmentary cross-sectional views of the cover strip and baffle element taken along lines 9—9 in FIG. 9.

DETAILED DESCRIPTION OF THE ILLUSTRATED EMBODIMENT

The present invention is directed to the visual aspects of a luminaire that provides direct lighting through a baffled down light opening. In general, the focus will be on the exhibited brightness and visual aspects of the luminaire at certain viewing angles which relate to normal fields of view. While use of the invention is not limited to any particular application, it is useful to reference the following brightness limitations established by the ANSI RP-1 standard for direct lighting in VDT environments:

| Degrees from Vertical | Preferred Maximum Average Luminaire |
|---|---|
| 55° | 248 FL (850 cd/m$^2$) |
| 65° | 102 FL (350 cd/m$^2$) |
| 75° | 51 FL (175 cd/m$^2$) |
| 85° and above | 51 FL (175 cd/m$^2$) |

where "FL" means footlamberts and "cd" means candelas. The above standard deals with a range of angles that can generally be considered within the normal field of view of a person located at a distance from the luminaire. For angles closer to vertical, i.e., at positions near or directly below the luminaire, glare is generally not a problem because the position of the overhead luminaire falls outside normal fields of view.

Figure 1:
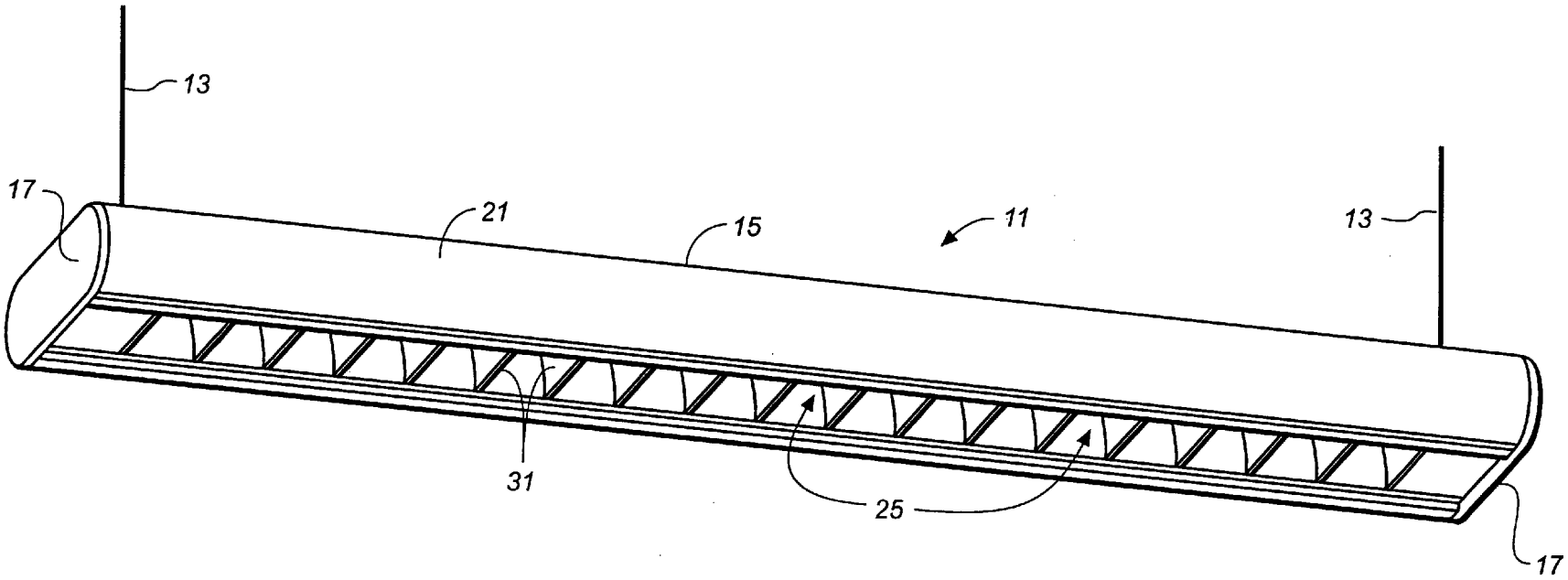
FIG. 1 is a bottom perspective view of a luminaire having a baffled down light opening.
Figure 2:
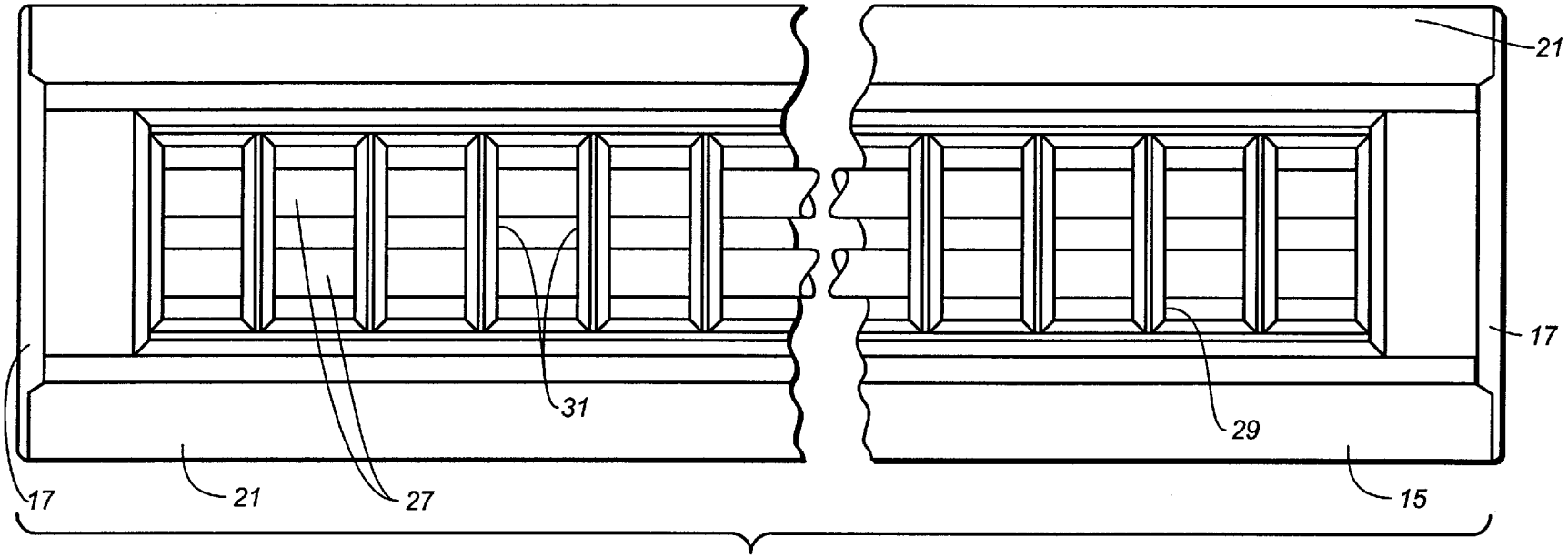
FIG. 2 is a bottom plan view thereof.
Figure 3:
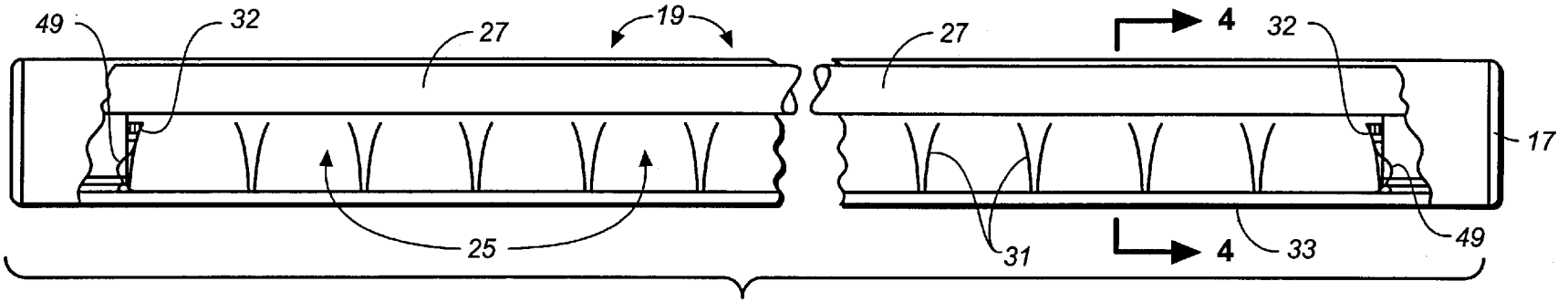
FIG. 3 is the side elevational cut-away view of the luminaire shown in FIG. 1 further illustrating the positioning of the baffle elements therein below the light source.

Referring now to the drawings, FIGS. 1–3 show a direct-indirect luminaire 11 suspended from an overhead ceiling (not shown) by means of suitable suspension cables 13. The luminaire includes an elongated opaque housing 15 having end caps 17, an open top 19, rounded sidewalls 21, and an elongated down light opening 25. A light source is provided in the housing in the form of two side-by-side fluorescent lamps 27 replaceably mounted in, and electrified by, suitable lamp sockets (not shown). As best shown in FIG. 2, it can be seen that the luminaire's fluorescent lamps extend directly over the elongated down light opening 25 such that the lamps are exposed through this opening. Typically, the brightness of such exposed lamps, when viewed directly, would be in the range of 2,000–8,000 footlamberts, depending on the type of lamp used. Such extremely high brightness levels will normally cause visual discomfort unless the lamps are shielded from direct view at normal viewing angles. To provide such shielding, a baffle structure 29 is inserted into down light opening 25 to shield the lamps as hereinafter described.

The luminaire's baffle structure 29 includes a plurality of transverse, equally spaced baffle elements 31 and opposed longitudinally extending baffle rails 33, all of which are suitably fabricated of sheet aluminum. The baffle elements are physically attached to the opposed baffle rails, such as by a tab and slot attachment (not shown), to provide an integral structure that can be inserted as a unit into the down light opening 25 of housing 15 below the luminaire's lamps 27. When installed, each of the spaced baffle elements extends in a generally vertical plane that is perpendicular to the plane of the lamps.

Figure 4:
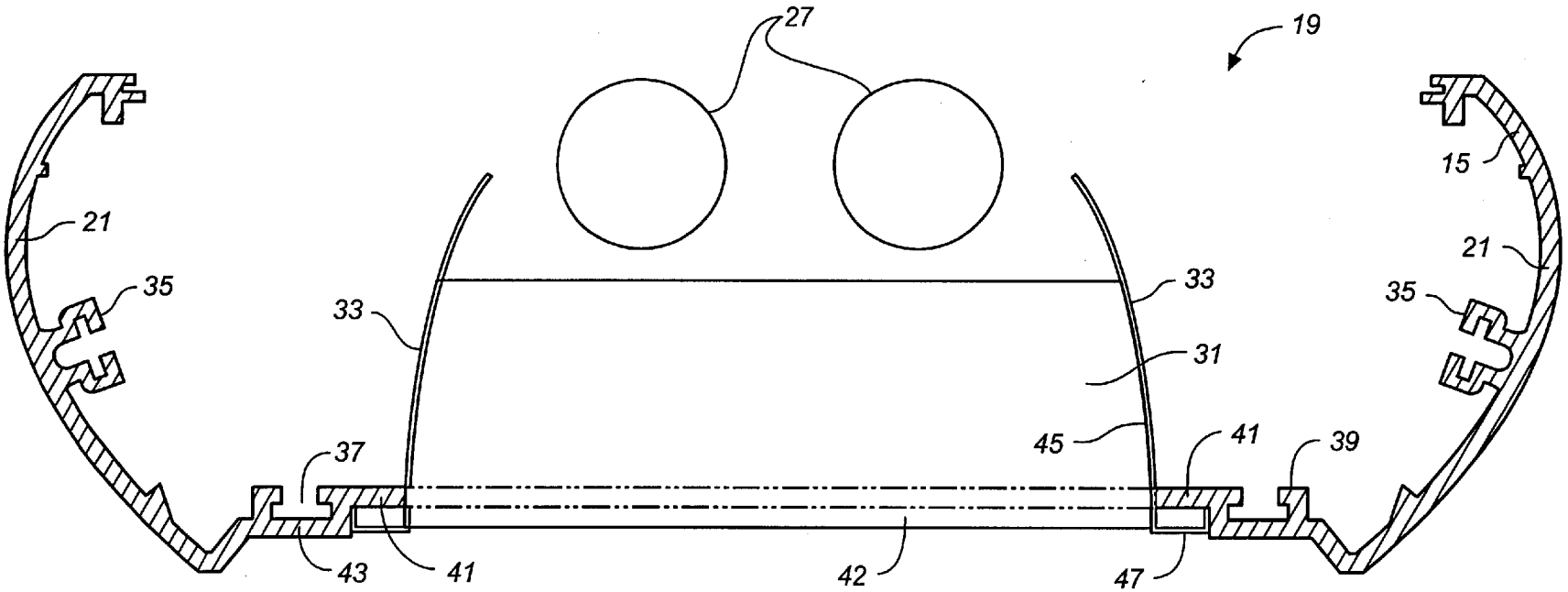
FIG. 4 is an enlarged cross-sectional view thereof taken along section lines 4—4 of FIG. 3.

Referring to FIG. 4, it can be seen that the luminaire housing 15 is suitably fabricated from an extruded part, e.g. aluminum, cut to a desired length, with suitable extruded internal mounting slots 35, 37 being provided for anchoring various internal parts of the luminaire, such as additional internal reflectors, ballast straps, and socket holders (not shown). The housing's top portion 19 is open to provide a top opening for indirect lighting, while direct lighting is produced through down light opening 25 formed in the extrusion's bottom wall 39. The down light opening 25, which can be produced by a punching procedure in the fabrication process, is surrounded by a shoulder 41 extending inwardly from a relatively thick portion 43 of the extrusion's bottom wall 39. This shoulder is sized to receive the channel-shaped edges 47 formed at the base ends 45 of baffle rails 33, which fit underneath the shoulder when the baffle structure is snapped into place in the direct light opening. Referring to FIG. 3, it can be seen that the baffle structure is removably retained in the down light opening by means of depressible spring clips 49 suitably attached to the end-most baffle elements 32 of baffle structure 29. When the baffle structure is inserted into the down light opening, spring clips 49 engage the extending shoulder along the ends 42 of the down light opening.

It will be appreciated that housing 15 could be made of a variety of materials and fabrication processes, for example, roll-formed steel, and that the baffle structure could be permanently or removably fastened within down light opening 25 by any suitable fastening or attachment means.

Figure 5:
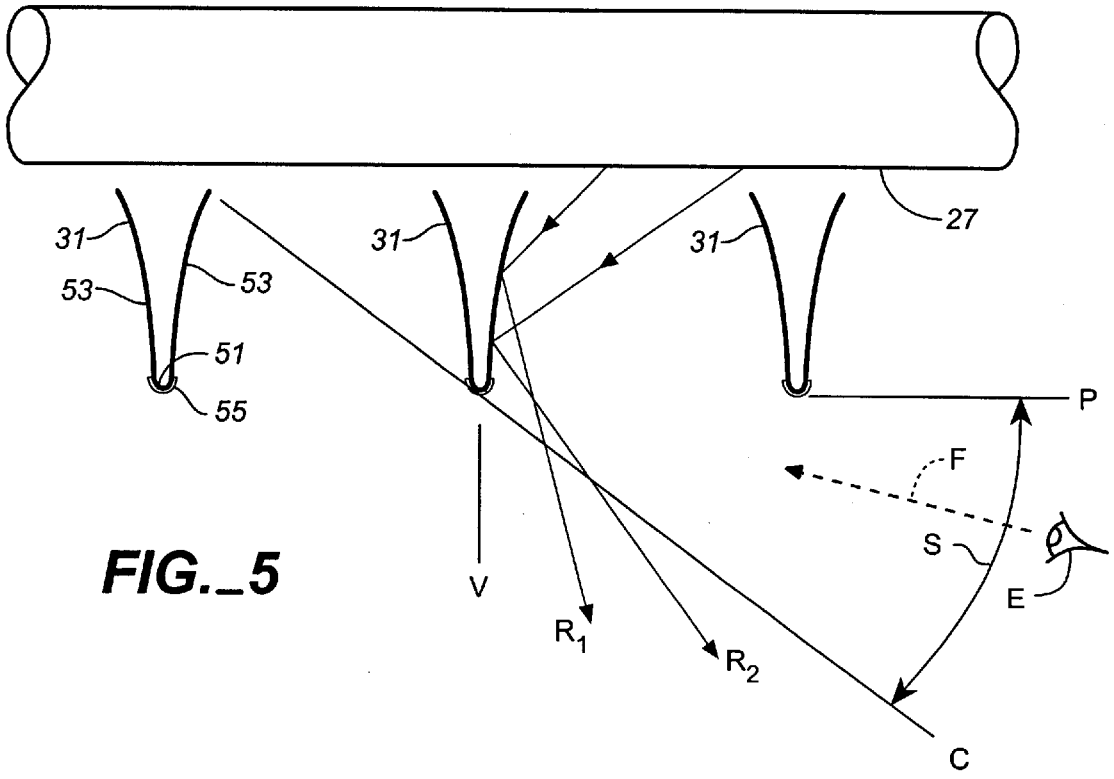
FIG. 5 is a graphical representation of the baffle elements of the luminaire of the invention illustrating the light distribution function of the baffle elements.
Figure 6:
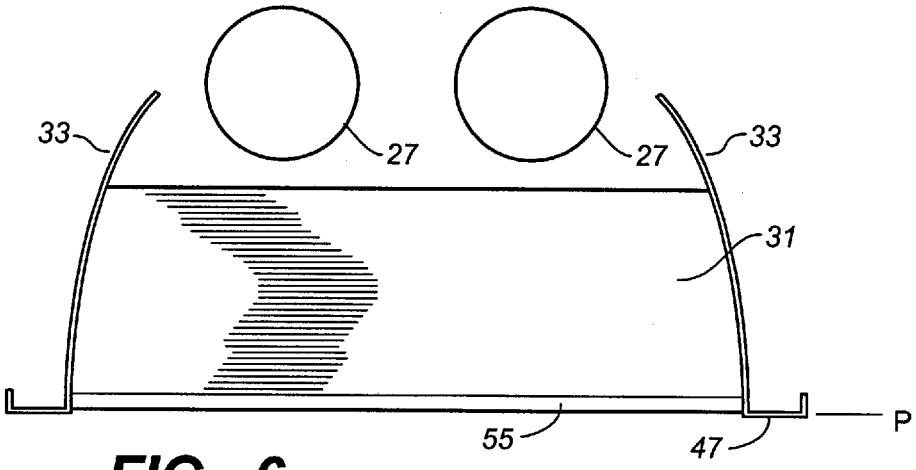
FIG. 6 is an elevational view of a baffle element and baffle rails forming the luminaire's baffle structure and showing the position of the baffle structure relative to the luminaire's light source.

The construction and shielding function of the baffle elements of baffle structure 29 will now be further described in reference to FIGS. 5 and 6 of the drawings, wherein equally spaced baffle elements 31 extending between curved baffle rails 33 are shown in their shielding position below lamps 27, and wherein the horizontal plane of the housing's down light opening 25 is denoted by the letter "P" and vertical is denoted by vertical line "V." Each of the baffle elements 31 is seen to include a bottom edge 51 and two back-to-back specular or semi-specular outer reflective surfaces 53 extending upward from this bottom edge. (The baffle rails 33 are similarly provided with specular or semi-specular reflective surfaces.) The baffle elements are disposed in the direct light opening 25 so as to provide a range of shielded viewing angles, denoted by the angle "S," between the plane P of the down light opening and a cutoff angle C which is determined by the depth of the baffle elements and their degree of separation. Within the shielded viewing angles S, the excessively bright surfaces of lamps 27 will be shielded from direct view as denoted by the graphic representation of the eye E in FIG. 5 observing the luminaire at a viewing angle defined by sight line F. Such baffle structures are well known and widely used in luminaires having a down light component.

To prevent the reflective surfaces of the baffle elements from introducing excessive brightness within the range of shielded viewing angles S, the baffle's specular (or semi-specular) reflective surfaces 53 are formed along a curve so as to control the directivity of the specular reflections from these surfaces. The desired reflection characteristics from these surfaces are illustrated by the ray traces R1 and R2 in FIG. 5 wherein light emitted by lamps 27 strikes the reflective surfaces at angles of incidence which effectively steer the reflected light away from the shielded angles. Due to their specular reflection characteristics, which would include specular and semi-specular, the brightness exhibited by these surfaces at most if not all shielded viewing angles will be relatively low, as, for example, would be the case with RP-1 compliant luminaires which produce brightness levels of less than about 250 footlamberts average at the lower range of the shielded angles (55 to 65 degrees above vertical) and brightness levels in the range of 50 footlamberts at roughly 75 degrees and above. At brightness levels of 50 footlamberts, the baffle surface will appear relatively dark to the observer, and thus, at high viewing angles, the entire down light opening 25 of the luminaire will be relatively dark and devoid of visual interest.

It is noted that the above-described baffles are often generically referred to as "parabolic" baffles, even though the curved reflective surfaces of the baffles are not necessarily parabolic.

Therefore, as used herein, the term "parabolic" shall mean any curved surface that achieves the light distribution functions described above.

Figure 7:
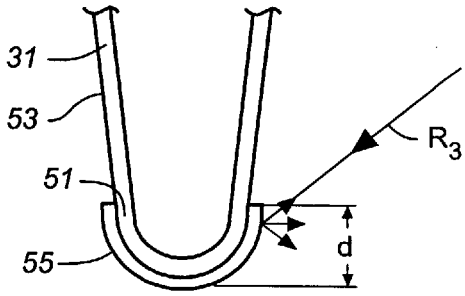
FIG. 7 is a fragmentary view of one of the luminaire's baffle elements showing the visual accent area applied to the bottom edge thereof.

In accordance with the invention, a visual accent area is provided on the light baffle elements 31 of luminaire 11 so as to add some observable brightness, but not excessive brightness, to the luminaire's otherwise dark down light opening 25 when this opening is seen at viewing angles within the shielded range of angles S. A visual accent is produced at these angles by a contrast in brightness between the visual accent area on the baffle elements and the baffle elements' relatively dark specular surfaces 53. As best shown in FIG. 7, the visual accent area is preferably provided in the form of a diffuse or semi-diffuse reflective stripe 55 applied along bottom edge 51 of baffle elements 31. The diffuse characteristics of this stripe will cause incident source light to reflect in a diffuse pattern as illustrated by ray trace R3 in FIG. 7, thereby boosting the observable brightness of the stripe at shielded viewing angles relative to the baffle's specular surfaces. The resulting contrast in brightness between adjacent baffle surfaces at viewing angles within the range of shielded viewing angles S provides visual interest along the bottom edges of the baffles. To avoid excessive brightness, the surface area of reflective stripe 55 should be relatively small as compared to the surface area of the baffle elements' reflective surfaces 53. This is achieved by controlling the extent to which the reflective stripe extends upward from bottom edge 51 onto the baffle's outer reflective surfaces. It has been found that, where a stripe is placed on every baffle, a desired visual accent can be produced without introducing excessive brightness by a reflective stripe that extends upward onto the baffle's reflective surfaces to a height denoted by the letter "d" in FIG. 7, of approximately 0.07 inches for baffles having an overall height of approximately 2½ inches and a separation of 2 5/16 inches. If the reflective stripe is extended substantially further onto the surfaces of the baffle elements for this baffle separation, the resulting brightness at shielded viewing angles will become more pronounced, thereby diminishing the desired visual benefits of the stripe. If the reflective stripe is made substantially smaller, the desired visual accent will diminish, eventually to the point where it will not be readily observable. The optimum size of the stripe will vary with the separation of the baffles (but not the length of the baffles nor generally with the baffle's height which will substantially exceed height of the stripe). This is because the human eye will tend to integrate the series of separated bright and dark areas to produce a perceived average brightness. For greater baffle separations, for example where stripes are placed on alternate baffles to produce greater separation between accented baffles, the height of the stripe should be somewhat larger in order to maintain the same perceived brightness, whereas if the separation is decreased it should be somewhat less. Generally, depending on the separation between accented baffles, a stripe extending up onto the baffles a height "d" of between approximately 1/16 to ⅛ of an inch (0.16 to 0.32 cm) should provide suitable perceived brightness for practical baffle designs. For some applications, such as luminaires suspended from high ceilings, the height of the shape may be somewhat greater, but would not be expanded to substantially exceed ¼ inch (0.64 cm).

The reflective stripe 55 can suitably be applied to the bottom edge of baffle element 31 using a white paint, however, it is understood that reflective paints of other colors could be provided for desired moods or visual effects. For example, luminaires having baffle elements accented as herein described could be provided in different colors at different locations within a building, thereby providing visual clues from the overhead lighting as to a person's location within the building. In any case, a paint should be chosen that has suitable diffuse reflection characteristics and that suitably adheres to metal surfaces at the operating temperatures of the luminaire. Alternatively, a reflective stripe 55 can be applied to the luminaire's baffle elements 31 by means of a non-specular reflective tape material adhered to the bottom edge of the baffle, or by other surface treatments that would produce a diffuse or semi-diffuse reflection along the edge of the baffle.

It will be understood that the invention is not limited to providing a visual accent area along the bottom edge of the luminaire's baffle elements. Accent areas could be provided at other locations on the baffle elements, provided they are visually perceptible at some or all shielded viewing angles. Furthermore, visual accent areas can be provided in discontinuous patterns, such as a series of intermittent reflective stripes or a dot pattern, applied at, along or near the baffle's bottom edge. However, providing a visual accent area in the form of a stripe along the baffle's bottom edge is considered to be the best mode of the invention, since it provides the most effective and easily observable accent on the baffle.

Furthermore, it is within the intended scope of the invention to provide a visual accent area on the luminaire baffles by means which are not reflective. For example, the baffle could be formed by a translucent plastic block sandwiched between two back-to-back, curved specular reflectors such that the bottom edge of the baffle is formed by the translucent block. In such an embodiment, the visual accent is produced by source light transmitted through the translucent block from the interior of the baffle causing an observable glow along the baffle's bottom edge which, at shielded viewing angles, contrasts with the low brightness surfaces of the reflectors. Another possible alternative would be to drill a series of holes in the bottom edge of the baffle to allow source light to spill directly from the bottom edge.

FIGS. 8, 8A, 8B, 9, 9A and 9B show a further means for applying a visual accent to the luminaire baffles using separately fabricated channel-shaped cover strips that fit over and are secured in place against the bottom edge of the baffles. The embodiments illustrated in these figures have a particular advantage over the use of reflective paint or tape in that, with reflective paint or tape, accent stripes which are straight and which have no irregularities along their edges are difficult to achieve in production at a practical cost. Any perceptible irregularities or non-uniformities in the luminous accents will present an annoying distraction to the observer which will often be deemed unacceptable. By using the structural accent elements described and illustrated herein, the coverage and parallelism of the top edges of the accent stripes can be precisely controlled, thereby avoiding visually distracting irregularities in the luminous accent, either across individual baffle elements or from one baffle element to another.

Figure 8:
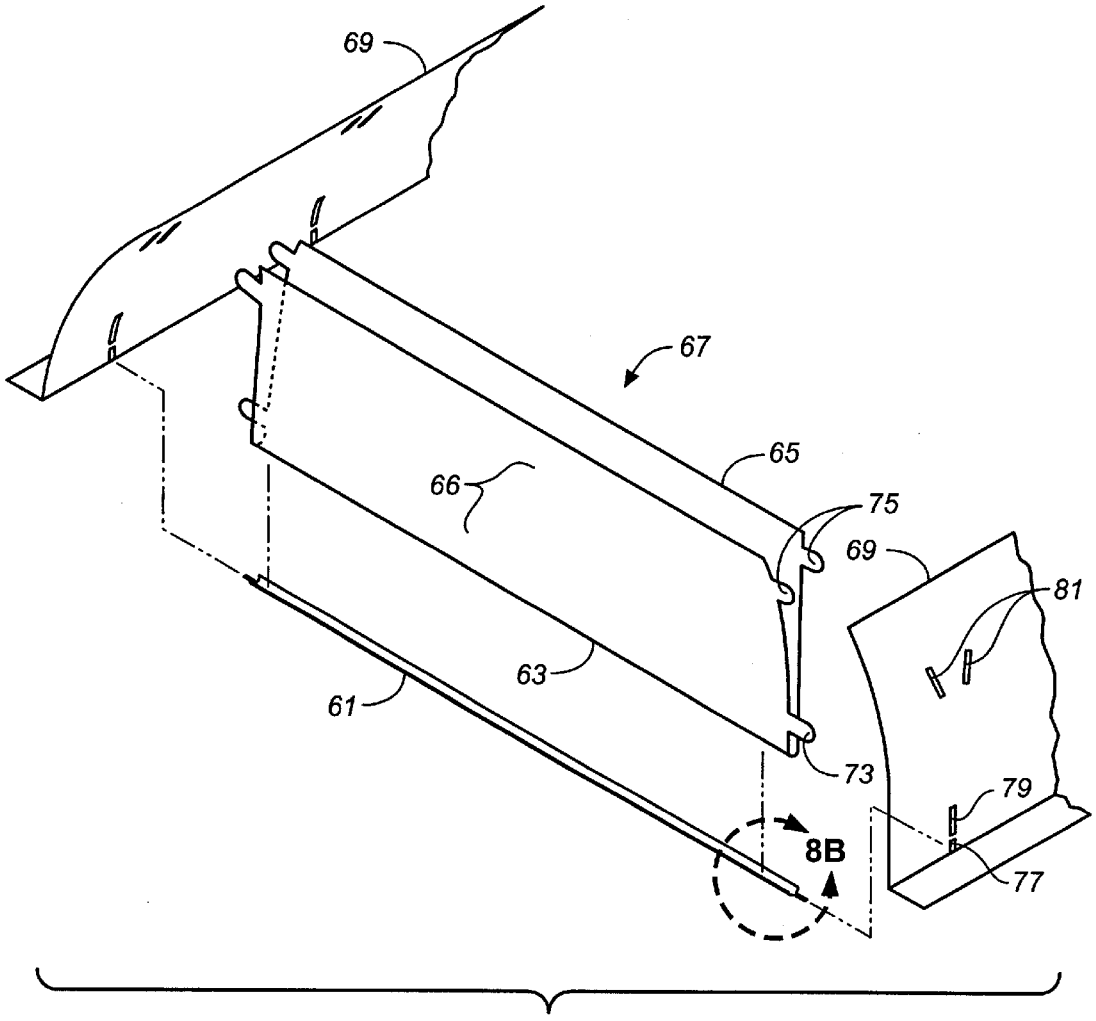
FIG. 8 is an exploded top perspective fragmentary view of a baffle element and associated baffle rails of an alternative embodiment of the invention wherein the visual accent area on the baffle is in the form of a channel-shaped accent cover strip secured along the baffle's bottom edge.
Figure 8A:
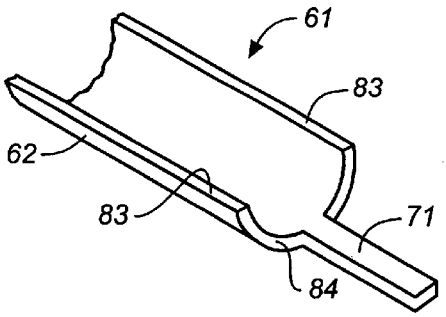
FIG. 8A is an enlarged top perspective view of the end of the accent cover strip shown in FIG. 8.
Figure 8B:
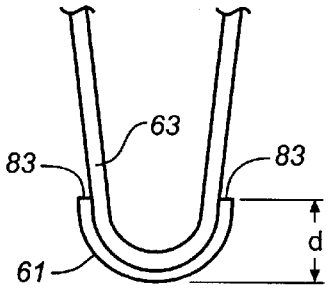
FIG. 8B is a fragmentary cross-sectional view of the bottom edge of the baffle element shown in FIG. 8 with the accent cover strip positioned against the bottom edge.

Referring to FIGS. 8, 8A, and 8B, a separate channel-shaped cover strip 61 having a high reflectance exterior surface 62 fits over the bottom edge 63 of baffle element 65 to provide the visual accent area along the baffle's bottom edge. The bottom cover strip 61 is preferably fabricated from a thin aluminum sheet material—suitably 0.018 inches (0.046 cm) thick, which has one of its surfaces, the one forming the strip's exterior surface 62, painted with a high gloss, UV resistant reflective paint of a selected color which is resistant to cracking and which provides a non-specular reflective surface. (The strip's exterior surface should be pretreated for good adhesion.) For a white accent area, a 90 percent reflectance high gloss white liquid polyurethane paint having a U/V stabilizer can be applied to the exterior surface to a thickness of about 0.002 inches (0.005 cm). When viewed at shielded viewing angles, such a surface treatment will provide a suitable contrast in surface brightness between the cover strip's reflective exterior surface 62 and the relatively dark back-to-back specular (or semi-specular) reflective surfaces 66, 67 of the baffle element.

The physical dimensions of cover strip 61 are critical to achieving a suitable visual accent along the bottoms of the baffle elements without introducing excessive brightness. Specifically, the height of the cover strip should be controlled within specified tolerances determined by the particular application. For a white accent area involving baffle elements which are approximately 3¾" (9.5 cm) wide and spaced approximately 2⁵⁄₁₆" (5.9 cm) apart, a suitable height for the cover strip is approximately 0.075 inches (0.190 cm ), with a suitable bottom radius (to the exterior surface 62) of about 0.056 inches (0.142 cm). A height outside this tolerance may be desired to achieve a particular subjective effect, however, the limits on the height will generally be governed by the principle of whether excessive brightness is introduced into the shielded viewing zones or whether so little brightness is introduced that, in practical effect, it becomes imperceptible. As previously indicated, the acceptable range for the height of the cover strip will be roughly ¹⁄₁₆ to ⅛ inches (0.16 to 0.32 cm.) in most applications, with heights substantially greater than ¼ inch (0.64 cm) being unacceptable.

It can be seen that the channel-shaped bottom strip 61 illustrated in FIGS. 8, 8A, and 8B, along with the baffle element 67, are attached to baffle side rails 69 by means of foldable tabs 71, 73, 75 which are formed at the ends of the cover strip and baffle element and which fit into corresponding slots 77, 79, 81 in the side rails. When held in place against bottom edge 63 of baffle element 67, the upper extent of the visual accent area produced by cover strip 61 is seen to be defined by the straight and parallel top edges 83 of the cover strip. Thus, by using the separate, dimensionally reproducible cover strips, the top edges of the visual accent area on each baffle will be precisely controlled and will be uniform from baffle to baffle.

It should be noted that the channel-shaped cover strip 61 is preferably formed so that the raw surfaces of its top edges 83 point straight upward, rather than having an outward angle that might generate undesirable reflections that in turn might distract from the uniform and regular appearance of the accented baffles.

FIGS. 9, 9A, and 9B show an alternative to the embodiment of the channel-shaped cover strip illustrated in FIGS. 8, 8A, and 8B. Here, upward projecting locking posts 87 formed on the interior side of cover strip 85 snap fit into corresponding openings 89 punched in the baffle element 91 along the baffle element's bottom edge 93. In this embodiment, the bottom strips 87 can easily be attached to the bottom edges of the baffle elements after they are assembled with the baffle side rails (not shown), and can readily be removed and replaced if, for example, their reflective surfaces are damaged or different colored accents are desired. The dimensional and reflectance requirements of the bottom strip 87 illustrated in FIGS. 9, 9A, and 9B would generally be the same as those described in connection with the bottom strip illustrated in FIGS. 8, 8A, and 8B. In either embodiment, it is noted that the ends of the channel-shaped cover strips, for example end 84 of cover strip 61 illustrated in FIG. 8A, should be angled inward slightly to accommodate the curve of the baffle's side rails, thereby permitting the cover strip to lie flat against the baffle's bottom edge without bowing or twisting.

The snap-on cover strip shown in FIGS. 9, 9A, and 9B preferably is a molded part fabricated of a fire retardant and U/V resistant plastic material, such as acrylic or polycarbonate plastic (such as a Bayer Makrolon 1143-1124 polycarbonate plastic), with a color additive sufficient to provide a high degree of opacity, for example, ten pounds per hundred of ACC10I5 WHT to obtain an opaque white acrylic. While acrylic is generally less expensive than polycarbonate plastic, polycarbonate has the advantage of being highly durable. For desired fire retardant characteristics, the plastic cover strip should be capable of meeting the Underwriting Laboratories horizontal burn rate specification U/L 94 HB.

Figure 10:
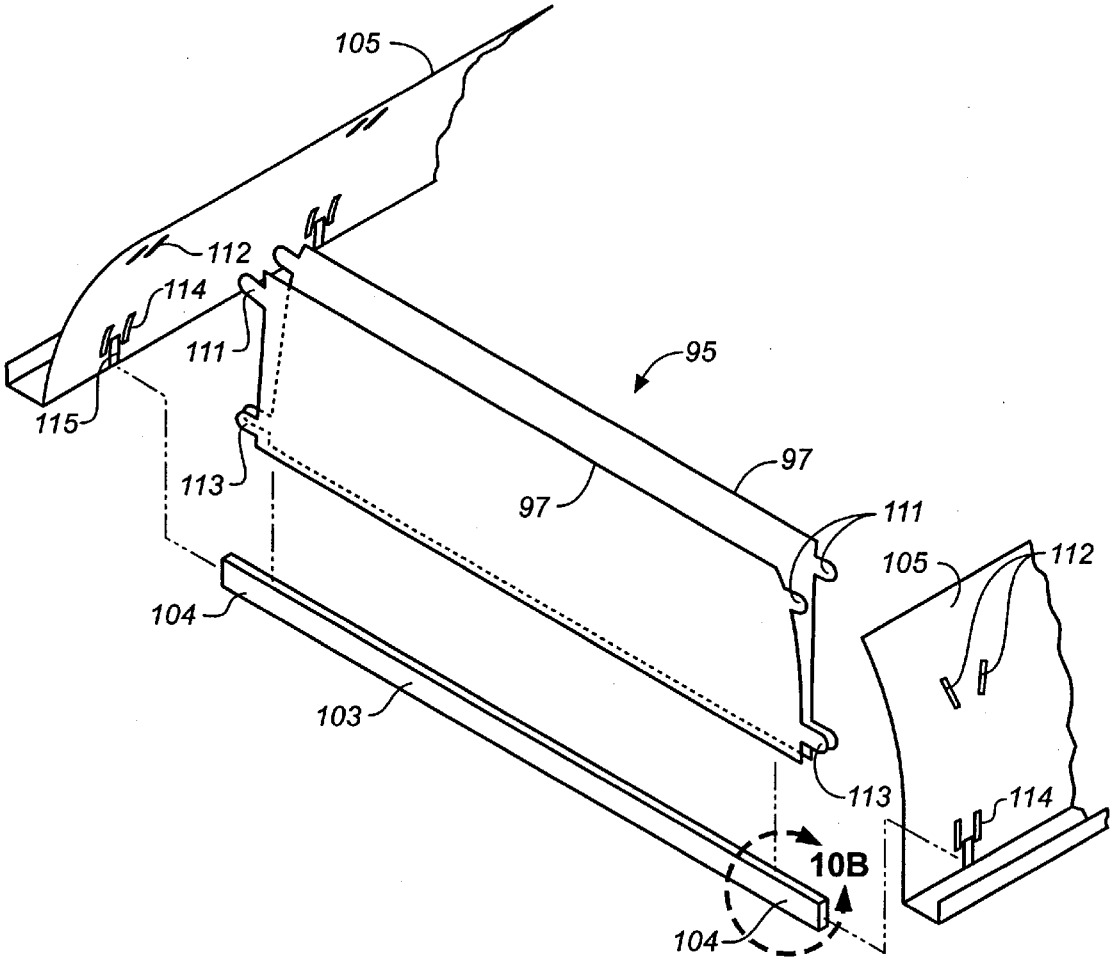
FIG. 10 is an exploded, top perspective view of yet another embodiment of the invention, wherein an elongated accent bar is sandwiched between back-to-back baffle walls to provide a visual accent along the bottom edge of the baffle.
Figure 10A:
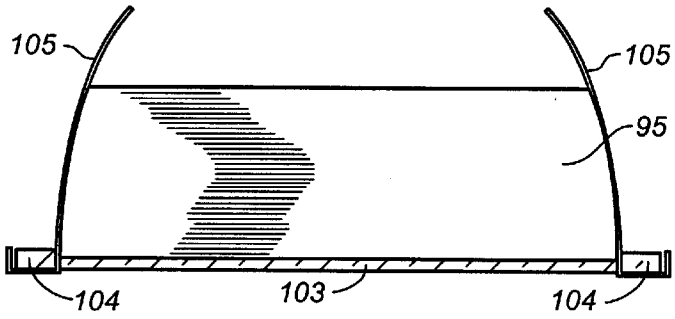
FIG. 10A is an elevational view of one of the luminaire baffle elements of the embodiment shown in FIG. 10.
Figure 10B:
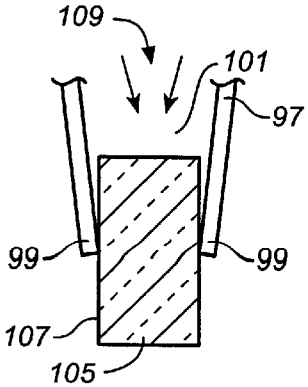
FIG 10B is a fragmentary cross-sectional view of the bottom edge of the baffle and accent bar shown in FIG. 10.

FIGS. 10, 10A, and 10B show yet another embodiment of the invention wherein baffle 95 is formed by back-to-back baffle walls 97 which converge at their bottom edges 99 to form a narrow bottom channel 101. An elongated accent bar 103 is sandwiched between baffle walls 97 within this bottom channel such that the lower edge 105 of the accent bar projects beyond the baffle wall's bottom edges 99 to produce an exposed surface area 107. The accent bar can suitably be either translucent or opaque. If opaque, the exposed surfaces of the bar produce an observable are of increased brightness along the bottom edge of the baffle by means of light reflected from the exposed surfaces of the bar element. If translucent, the incresed brightness is produced at least in part by light passing through the bar element from the interior of the baffle as illustrated by light rays 109 shown in FIG. 10B. Like the cover strip shown in FIGS. 8 and 9, the projecting accent bar of the embodiment of FIGS. 10, 10A, and 10B permits a visual accent to be provided along the bottom edge of the baffle which is straight and which is without irregularities along its edges.

As best illustrated in FIG. 10, the back-to-back baffle walls 97 are secured between the opposed baffle side rails 105 of this embodiment by means of foldable tabs 111, 113 projecting from the end of the baffle walls, which engage corresponding slots 112, 114 in the side rails. Similarly, the accent bar 103 is held in place between bottom edges 99 of baffle walls by inserting the extended ends of the accent bar through side rail openings 111 when the baffle structure is assembled. Like the snap-on cover strip 85 shown in FIG. 9, the accent bar can suitably be fabricated of a fire retardant and U/V resistant plastic, such as acrylic, with a color additive to provide a desired degree of translucency or opacity and desired diffusion characteristics. White opal can suitably be used as a color additive. Other color accents can be used to provide a color accent other than white if desired.

To achieve a suitable contrast in brightness between the visual accent areas of the baffle elements and the baffle elements' reflective surfaces, the contrast in brightness should be sufficient to produce a readily observable visual accent. Preferably, at shielded viewing angles, the brightness of the relatively small visual accent area on the baffle elements will fall in a range of approximately 250 to 500 footlamberts, while the relatively low brightness of the reflective surfaces of the baffle elements themselves will preferably meet RP-1 standards for preferred maximum average luminances for angles from 55 to 90 degrees above vertical. A brightness ratio of roughly 4:1 between the visual accent area and the baffles' reflective surfaces will provide optimal contrast to produce the desired visual accent. Higher and lower ratios will also produce desired accents, however, the observability of the accent will diminish as this ratio is substantially below 4:1. If brightness ratios are increased substantially above the 4:1 ratio, the visual accent area may become so bright that visual comfort will be negatively affected.

It is noted that the above-described brightness and contrast parameters need not be achieved at all shielded viewing angles within the range of shield viewing angles. However, the design goal normally should be to maximize the range of angles over which these parameters will obtain. Generally, the roughly 4:1 ratio of brightness will be more readily attained at higher angles relative to vertical within the shielded zone.

In accordance with the method of the invention, a baffle structure 29 having parabolic baffle elements 31 are used as the shielding means of choice for the down light opening 25 of luminaire 11 (see generally FIGS. 1–6). To provide visual interest and to communicate orientation and circulation within an architectural or outdoor space, the parabolic baffle elements are provided with visual accent areas as herein described which are observable at at least some shielded viewing angles, and preferably all such angles. The method also contemplates illuminating outdoor or architectural spaces using luminaires of the invention to communicate orientation information by color coding the visual accent areas of the luminaire baffles.

While the present invention has been disclosed in considerable detail in the foregoing specification, as well as in the accompanying drawings, it will be understood that it is not intended that the application be limited to such detail, except as necessitated by the following claims. For example, the invention is not intended to be limited to elongated linear luminaires as illustrated in the drawings; it could as well be applied to luminaires having circular baffle structures or parabolic louver structures such as commonly used in recessed and surface mounted trouffers. In either case baffle surfaces or edges would be accented as herein described. Also, the visual accent could be placed on other observable surfaces in proximity to the baffles, for example, the bottom edge of baffle rails 33, provided the surfaces receive source light through the down light opening of the luminaire and produce a contrasting brightness with the baffle surfaces. However, accenting the baffles as herein described is considered the most effective means of providing an observable accent in a luminaire's baffled down light opening at shielded viewing angles.

What we claim is:

1. A luminaire comprising a housing for a light source, said housing having a down light opening extending in a defined plane below the light source, at least one light baffle element disposed in said down light opening for shielding the light source in said housing within a range of shielded viewing angles below the plane of said down light opening, said baffle element having a bottom edge and at least one observable surface extending upward from said bottom edge, said observable surface exhibiting relatively low observable brightness when viewed at at least some shielded viewing angles within said range of shielded viewing angles, and a visual accent area on said luminaire which is observable at shielded viewing angles where the observable outer surface of said baffle element exhibits relatively low brightness, said visual accent area being provided on an outer surface of said luminaire in close proximity to the observable outer surface of said baffle element and exhibiting relatively high observable brightness at such shielded viewing angles as compared to the brightness exhibited by the observable surface of said baffle element at such viewing angles.

2. The luminaire of claim 1 wherein said visual accent area has a surface area that is small relative to the surface area of the observable surface of said light baffle element.

3. The luminaire of claim 1 wherein said visual accent area is provided on the at least one outer surface of said baffle element.

4. The luminaire of claim 3 wherein said visual accent area is provided on the at least one outer surface of said light baffle element in proximity to the bottom edge thereof.

5. The luminaire of claim 4 wherein said visual accent area is provided on the at least one outer surface of the light baffle element along the bottom edge thereof.

6. The luminaire of claim 3 wherein the visual accent area is provided in the form of a reflective stripe applied to said light baffle element substantially parallel to the bottom edge thereof.

7. The luminaire of claim 6 wherein said reflective stripe is applied along the bottom edge of said baffle element and wherein said stripe extends onto the observable surface of said baffle element to a height of approximately 1/16 to 1/4 of an inch (0.16 to 0.64 cm) from said bottom edge.

8. The luminaire of claim 3 wherein the visual accent area is applied to said baffle element by means of a reflective paint.

9. The luminaire of claim 1 wherein the at least one observable outer surface of said light baffle element is a curved reflective surface having specular reflection characteristics.

10. The luminaire of claim 1 wherein said visual accent area has diffuse reflection characteristics.

11. The luminaire of claim 1 wherein the ratio between the brightness of the visual accent area and the reflective surface of said baffle element is at least approximately 4:1 when viewed at at least some shielded viewing angles within said range of shielded viewing angles.

12. A luminaire comprising a housing for a light source, said housing having a down light opening extending in a defined plane below the light source, at least one light baffle element disposed in said down light opening for shielding the light source in said housing within a range of shielded viewing angles below the plane of said down light opening, said baffle element having a bottom edge and at least one observable outer surface extending upward from said bottom edge, said observable outer surface exhibiting relatively low observable brightness when viewed at at least some shielded viewing angles within said range of shielded viewing angles, and a visual accent area on said luminaire which is observable at shielded viewing angles where the observable outer surface of said baffle element exhibits relatively low brightness, said visual accent area being provided on an outer surface of said luminaire in close proximity to the observable outer surface of said baffle element and exhibiting relatively high observable brightness at such shielded viewing angles as compared to the brightness exhibited by the observable surface of said baffle element at such viewing angles, the brightness of the visual accent area at at least some shielded viewing angles being in a range of approximately 250–500 footlamberts.

13. A luminaire comprising a housing for a light source, said housing having a down light opening extending in a defined plane below the light source, a plurality of light baffle elements disposed in spaced relation in said down light opening for shielding the light source in said housing within a range of shielded viewing angles below the plane of said down light opening, each of said baffle elements having a bottom edge and oppositely facing outer reflective surfaces extending upward from said bottom edge, the outer reflective surfaces of each of said baffle elements having specular reflective characteristics and being formed to exhibit relatively low observable brightness when viewed at at least some shielded viewing angles within said range of shielded viewing angles, and a visual accent area on at least one of said light baffle elements in proximity to the bottom edge thereof and observable at shielded viewing angles where the reflective surfaces of said baffle elements exhibit relatively low brightness, said visual accent area having an outer surface area that is relatively small compared to the outer surface area of the reflecting surfaces of said baffle element and having diffuse reflective characteristics so as to exhibit relatively high observable brightness as compared to the brightness exhibited by the reflective surfaces of said baffle elements when viewed at at least some shielded viewing angles.

14. The luminaire of claim 13 wherein said visual accent area is provided in the form of a reflective stripe applied along the bottom edge of said baffle element and wherein said reflective strip extends upward onto the outer reflective surfaces of said baffle element to a height of approximately 1/16 to 1/4 of an inch (0.16 to 0.64 cm) from said bottom edge.

15. The luminaire of claim 13 wherein said visual accent area is provided in the form of a separate channel-shaped cover strip secured along the bottom edge of said baffle element, said cover strip having an observable outer surface which exhibits relatively high observable brightness at shielded viewing angles as compared to the observable brightness exhibited by the reflective surface of said baffle element when viewed at the same shielded viewing angles.

16. The luminaire of claim 15 wherein said channel-shaped cover strip has parallel top edges that define the upward extension of the visual accent area from the bottom edge of said baffle element.

17. The luminaire of claim 16 wherein a cover strip is secured to the bottom edge of a plurality of baffle elements of the luminaire.

18. The luminaire of claim 17 wherein said cover strips are removably securable over the bottom edge of said baffle elements.

19. The luminaire of claim 16 wherein said cover strip has a defined height of between approximately 1/16 to 1/4 inch (0.16 to 0.64 cm).

20. The luminaire of claim 13 wherein at least one of said baffle elements is formed by back-to-back baffle walls having reflective surfaces and bottom edges and wherein said visual accent area is provided in the form on an elongated accent bar held between the bottom edges of said baffle walls, said accent bar having a lower edge that projects below the bottom edges of said baffle walls to provide an observable exterior surface which exhibits relatively high observable brightness at shielded viewing angles as compared to the observable brightness exhibited by the reflective surface of said back-to-back baffle walls when viewed at the same shielded viewing angles.

21. The luminaire of claim 20 wherein said accent bar is translucent whereby a visual accent of relatively high observable brightness is produced at least in part by source light passing through said accent bar from within said baffle element.

22. The luminaire of claim 20 wherein said accent bar is opaque whereby a visual accent of relatively high observable brightness is produced at by source light reflected from said accent bar.

23. A luminaire comprising an elongated housing for a light source, said housing having an elongated down light opening extending in a defined plane below the light source, a plurality of light baffle elements disposed in spaced relation in said down light opening for shielding the light source in said housing within a range of shielded viewing angles below the horizontal plane of said down light opening, each of said baffle elements having a bottom edge and oppositely facing outer reflective surfaces extending upward from said bottom edge, the reflective surfaces of each of said baffle elements having specular reflective characteristics and being formed to exhibit relatively low observable brightness when viewed at shielded viewing angles within said range of shielded viewing angles, and a visual accent area on an outer surface of at least one of said light baffle elements which is observable at shielded viewing angles where the reflective surfaces of said baffle elements exhibit relatively low brightness, said visual accent area having a surface area that is relatively small compared to the surface area of the outer reflecting surfaces of said baffle element and having diffuse reflective characteristics that exhibit relatively high observable brightness as compared to the brightness exhibited by the reflective surfaces of said baffle elements when viewed at at some shielded viewing angles.

24. The luminaire of claim 23 wherein said visual accent area is provided on substantially all of said plurality of light baffle elements.

25. The luminaire of claim 23 wherein said visual accent area is provided by a reflective stripe running along the bottom edge of said light baffle element.

26. The luminaire of claim 25 wherein said visual accent area extends upward from the bottom edge of said light baffle element onto both reflective surfaces of said baffle elements to a height of approximately 1/16 to 1/4 (0.16 to 0.64 cm) of an inch from said bottom edge.

27. The luminaire of claim 23 wherein the visual accent area is applied to said baffle element by means of a reflective paint.

28. A luminaire comprising an elongated housing having an elongated down light opening extending in a defined plane, a light source disposed in said housing over said down light opening, a plurality of light baffle element disposed in said down light opening for shielding said light source within a range of shielded viewing angles below the plane of said down light opening, each of said baffle elements having a bottom edge and oppositely facing reflective surfaces extending upward from said bottom edge, said reflective surfaces being formed to exhibit low observable brightness when viewed at at least some shielded viewing angles within said range of shielded viewing angles, and a visual accent area provided along the bottom edge of said light baffle elements, said visual accent area having a surface area that is relatively small compared to the surface area of the reflecting surfaces of said baffle element and exhibiting relatively high observable brightness as compared to the brightness exhibited by the outer reflective surfaces of said baffle elements when viewed at shielded viewing angles where said reflective surfaces exhibit relatively low brightness.

29. The luminaire of claim 28 wherein the outer reflective surface of each of said light baffle elements has specular reflective characteristics and wherein the visual accent area on said baffle elements has diffuse reflection characteristics.

30. The luminaire of claim 29 wherein the ratio between the brightness of the visual accent area of each said baffle element and the outer reflective surfaces thereof is at least approximately 4:1 at shielded viewing angles.

31. The luminaire of claim 30 wherein the brightness of the visual accent area of each said baffle element at shielded viewing angles is in a range of approximately 250–500 footlamberts.

32. A method of shielding the down light opening of a luminaire for direct lighting while providing visual interest in said down light opening and wherein the down light opening extends in a defined plane, said method comprising inserting light baffle elements in said down light opening for shielding the light source of the luminaire from direct view through said down light opening within a range of shielded viewing angles below the plane of the down light opening, providing a relatively small visual accent area of relatively high brightness on an outer surface of said light baffle elements which is observable at shielded viewing angles within said range of shielded viewing angles, and otherwise avoiding relatively high brightness surfaces on said light baffle elements at at least some shielded viewing angles.

33. The method of claim 32 wherein the relatively small visual accent area of relatively high observable brightness is provided on an outer surface along a bottom edge of said light baffle elements.

34. The method of claim 33 wherein the visual accent area is confined to an area on the baffle elements which extends no less and no more than approximately 1/16 to 1/4 (0.16 to 0.64 cm) inch above the bottom edge of said light baffle elements.

35. The method of claim 34 wherein the ratio between the brightness of the visual accent area of each said baffle element and the outer reflective surfaces thereof is at least approximately 4:1 at at least some shielded viewing angles within said range of shielded viewing angles.

36. The method of claim 35 wherein the brightness of the visual accent area of each said baffle at shielded viewing angles where the outer reflective surfaces of the baffle element exhibits relatively low brightness is in a range of approximately 250–500 footlamberts.

37. A method of illuminating spaces comprising providing a plurality of overhead luminaires for direct lighting in spaces wherein each of said luminaires has a down light opening which extends in a defined plane, providing baffle elements in the down light opening of said plurality of luminaires for shielding the light sources thereof from direct view within a range of shielded viewing angles below the plane of the down light opening, providing a relatively small visual accent area of relatively high brightness on an outer surface of the light baffle elements of said luminaires which are observable at at least some shielded viewing angles within said range of shielded viewing angles, and otherwise avoiding relatively high brightness surfaces on the light baffle elements of said luminaires at said shielded viewing angles.

38. The method of claim 37 wherein said visual accent areas are color coded to denote location within an architectural space.

* * * * *